United States Patent [19]

Liaaen

[11] 4,112,866

[45] Sep. 12, 1978

[54] PROPELLER MECHANISM HAVING REMOVABLE PROPELLER SHAFT

[75] Inventor: Anders Marius Liaaen, Alesund, Norway

[73] Assignee: A.M. Liaaen A/S, Ålesund, Norway

[21] Appl. No.: 791,697

[22] Filed: Apr. 28, 1977

[51] Int. Cl.[2] ..... B63H 1/14

[52] U.S. Cl. ..... 115/34 R

[58] Field of Search ..... 115/34 R, 34 A, 34 B, 115/17, 18 R

[56] References Cited

U.S. PATENT DOCUMENTS

| | | | |
|---|---|---|---|
| 2,093,357 | 9/1937 | Harper | 115/17 |
| 2,153,626 | 4/1939 | Kissel | 115/17 |
| 2,164,487 | 7/1939 | Beckjord | 115/34 R |
| 3,727,574 | 4/1973 | Bagge | 115/17 |

*Primary Examiner*—Trygve M. Blix
*Assistant Examiner*—Sherman D. Basinger
*Attorney, Agent, or Firm*—Watson, Cole, Grindle & Watson

[57] ABSTRACT

A vessel propeller mechanism comprising a pair of shafts extending at an angle to each other and interconnected through a pair of conical gears, one of which is carried by a sleeve member which is supported in the mechanism housing and serves to support and rotate its associated shaft, the sleeve member and its shaft being so interconnected that the shaft may be axially withdrawn without disturbing the positioning of the gears and the sleeve member.

2 Claims, 1 Drawing Figure

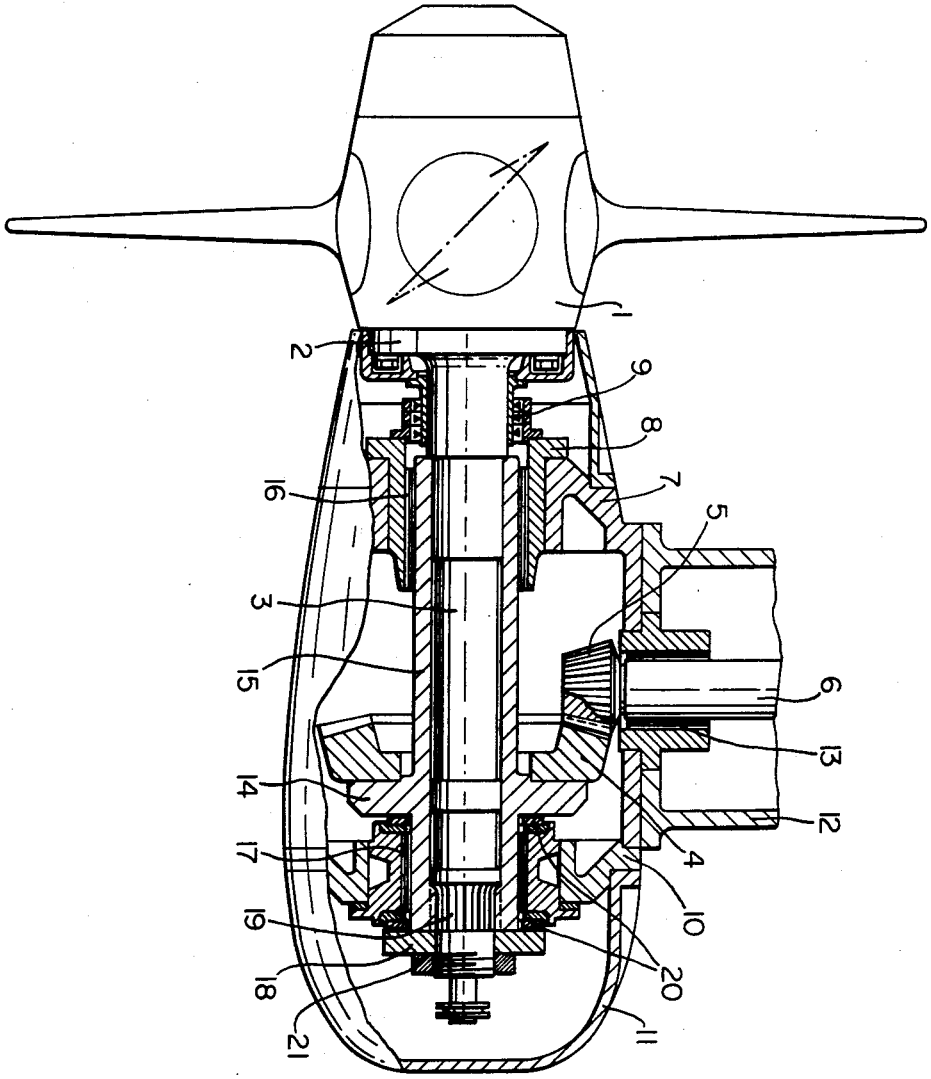
1
2
9
8
7
5
16
3
15
6
13
14
12
4
17
10
19
20
18
11
21

PROPELLER MECHANISM HAVING REMOVABLE PROPELLER SHAFT

BACKGROUND OF THE INVENTION

The present invention relates to a vessel propeller mechanism of the type wherein drive is supplied to the propeller shaft through a set of conical gears from a shaft which extends at an angle, preferably a right angle to the propeller shaft.

In such mechanisms in which the propeller blade assembly is flange connected to its shaft, the propeller shaft is normally connected directly to a conical gear thereon. Mechanisms are also known in which the connection between the propeller shaft and the conical gear is made through a sleeve member which is also adapted to support the propeller shaft. Mechanisms of both these types, however, create difficulties during disassembly thereof as when the propeller shaft needs to be withdrawn for the revision of packing boxes or the replacement of components therein or in the housing enclosing the gears. Such difficulties mainly result because it is necessary to dismount at least one support bearing together with a pressure bearing of the propeller shaft.

SUMMARY OF THE INVENTION

The present invention relates to a mechanism of the last mentioned type wherein the propeller shaft is driven by a drive shaft having a conical gear thereon and extending at an angle to the propeller shaft. The conical gear intermeshes with a gear which surrounds with the propeller shaft and which is supported on a sleeve member mounted in a housing enclosing the gears. Those difficulties referred to above are thus avoided since the propeller shaft is connected to the gear sleeve in such a manner permitting the propeller shaft together with the propeller blade assembly to be axially withdrawn from the housing without disturbing the drive transmission elements within the housing.

With such a mechanism according to the invention, the propeller shaft may be axially withdrawn upon the loosening of an axial locking device while the sleeve, the intermeshed gears and the associated support bearing or bearings remain intact. Thus, none of the parts in the gear and bearing housing are disturbed since there is no need of a loosening, repositioning or adjusting operation.

BRIEF DESCRIPTION OF THE DRAWING

The accompanying drawing FIGURE is a sectional longitudinal view of the propeller mechanism according to the invention.

DETAILED DESCRIPTION OF THE INVENTION

The propeller mechanism 1 shown in the single drawing FIGURE includes a propeller blade assembly which may be of the controllable or constant pitch type. The assembly is connected through a flange 2 to a propeller shaft 3 which is driven via intermeshed conical gears 4, 5 and a shaft 6 which is shown extending at right angles to shaft 3 but which may otherwise extend at an acute angle thereto. Shaft 3 and gears 4, 5 are disposed within an oil filled housing 7 which is closed at its aft (left) end by a cover 8 and which joins shaft 3 through a packing box 9. Housing 7 is closed at its forward (right) end by means of inner and outer covers 10 and 11, and shaft 6 is disposed in a housing 12 which is secured to housing 7 and which includes a support bearing 13 for shaft 6 with its gear 5 thereon. Shaft 6 extends from a propulsion motor located within a vessel (on which the present mechanism is mounted), and housing 12 may be connected to means (not shown) adapted to turn the housing about the axis of shaft 6, so that the propeller mechanism may serve to steer the vessel.

Gear 4 is secured to a flange 14 of a sleeve 15 which is co-axial with shaft 3 and is supported in bearings 16, 17 mounted in housing 7 and at the free (right) end carrying a pressure ring 18. Shaft 3 is supported in sleeve 15 and is connected thereto through a spline connection 19, or the like, so as to cause sleeve 15 to rotate together with shaft 3 while permitting shaft 3 to be axially withdrawn from sleeve 15. The axially directed force exerted by shaft 3 when 1 is in operation is transferred to cover 10 on housing 7 by means of pressure ring 18 and flange 14 through pressure bearing rings 20. Shaft 3 is locked axially to sleeve 15 by means of a locking nut 21.

Thus, in dismantling blade assembly 1 and its shaft 3 from the present propeller mechanism, only nut 21 need be loosened to permit shaft 3 to be axially withdrawn in a direction to the left in the drawing. However, with shaft 3 removed, sleeve 15 remains in its original position in its bearing 16, 17, and gears 4, 5 remain intermeshed. Also, the interior of housing 7, between covers 8 and 10, remain in an oil-tight sealed condition.

In the embodiment shown in the drawing, sleeve 15 is shown of such a length that it is supported in both bearings 16 and 17. However, if need be, sleeve 15 may be supported only in bearing 17, with bearing 16 arranged to directly support shaft 3. With such an arrangement sleeve 15 would not provide the same stable support for gear 4 as compared to the illustrated arrangement which includes a longer sleeve length, and housing 7 would not be sealed at the time shaft 3 is withdrawn.

I claim:

1. A propeller mechanism, comprising a casing, a propeller shaft disposed in said casing, means for rotating said propeller shaft including a drive shaft disposed at an angle to said propeller shaft and intermeshed bevel gears, one of said gears being coaxially disposed on said drive shaft, a sleeve member surrounding said propeller shaft, the other of said gears being mounted on said sleeve member and being coaxially disposed relative to said propeller shaft, bearing means in said casing in engagement with said sleeve member for supporting said other bevel gear in an intermeshed position with said one bevel gear, said propeller shaft thereby being indirectly supported by said bearing means, and means for detachably securing said propeller shaft within said sleeve member for preventing rotational movement of said propeller shaft and said sleeve member relative to one another but permitting axial withdrawal of said propeller shaft from within said sleeve member while maintaining said intermeshed position of said gears.

2. The mechanism according to claim 1, wherein said securing means comprises a splined connection between said sleeve member and said propeller shaft.

* * * * *